US005657743A

United States Patent [19]

Schwarzbäcker et al.

[11] Patent Number: 5,657,743

[45] Date of Patent: Aug. 19, 1997

[54] COOKING DEVICE

[75] Inventors: Werner Schwarzbäcker, Egling; Georg Pollinger, Lenggries, both of Germany

[73] Assignee: Convotherm Elektrogeraete GmbH, Egling, Germany

[21] Appl. No.: 539,990

[22] Filed: Oct. 6, 1995

[30] Foreign Application Priority Data

Oct. 7, 1994 [DE] Germany ..... 44 35 932.2

[51] Int. Cl.[6] ..... F23M 7/00

[52] U.S. Cl. ..... 126/194; 49/176; 432/250

[58] Field of Search ..... 126/194; 49/176; 432/250

[56] References Cited

U.S. PATENT DOCUMENTS 266,829 10/1882 Johnston ..... 49/176

2,252,139 8/1941 Schlacter .

2,584,404 2/1952 Webb ..... 126/194

FOREIGN PATENT DOCUMENTS 2252021 5/1973 Germany .

*Primary Examiner*—Carroll B. Dority

*Attorney, Agent, or Firm*—McAulay Fisher Nissen Goldberg & Kiel, LLP

[57] ABSTRACT

In a cooking device having a housing which can be closed by a door, a hinge support in the form of a slide or carriage is guided at one side wall so as to be displaceable at guide rails which are arranged horizontally at the side wall. One part of a hinge arrangement is fastened at the hinge support and the other part of the hinge arrangement is fastened to the door. The hinge support is guided at the guide rail by guide rollers which contact the guide rails in a positive engagement without play. In this way it is possible when opening the door to displace the same into a parallel position alongside the side wall.

8 Claims, 3 Drawing Sheets

COOKING DEVICE

BACKGROUND OF THE INVENTION a) Field of the Invention

The invention is directed to a cooking device with a housing and a door which closes a front opening and which is swivelable about a vertical axis by means of a hinge arrangement.

b) Description of Related Art

Doors for cooking devices are generally fitted at the right-hand open side of the housing of the cooking device. In the event that the spatial layout of the kitchen in which such cooking devices are set up does not allow for a door hinged on the right, the user must have a device with a door which is hinged on the left. Since the opening of the cooking device frequently does not extend the full width of the housing and operating buttons and display devices are provided on the from side of the closed part of the housing, changing the side on which the door is fired is often complicated with respect to construction.

OBJECT AND SUMMARY OF THE INVENTION

The primary object of the present invention is to provide a cooking device in which the side on which the door is fitted need not be changed regardless of problems with respect to setup and space.

According to the invention, this object is met in a cooking device of the type mentioned above in that one part of the hinge arrangement is arranged at the door and the other part of the hinge arrangement is arranged at a hinge support which is displaceable along the side wall of the housing adjacent to the hinge arrangement in the direction of the rear wall of the housing by means of a guide device, in that the hinge axis is arranged in a plane parallel to and a distance from the lateral surface of the housing, and in that the displacement path of the hinge support is limited in the direction of the open side of the housing by limiting means to the required distance between the swivel axis of the hinge arrangement and the front edge of the housing.

As a result of this design, the door can be displaced by means of the guide device in the direction of the rear side of the housing along and directly adjacent to the side wall associated with the hinge arrangement into a position where it is located at right angles to the front edge of the housing so that the door is located next to the side wall of the housing in the displaced position. As a result of this design, the cooking device need only be set up at such distance from the wall of the room or from another adjacent kitchen device that there is sufficient room for the door to be slid in. Since the door can be slid in next to the device in the opened state and accordingly no longer extends into the space in front of the device, it is no longer necessary to change the side on which the door is hinged. Accordingly, all cooking devices can be constructed in the same manner regardless of any problems relating to the location in which they are set up so as to obviate expensive rebuilding and special orders.

According to a construction of the invention, a particularly simple design with respect to the limiting means defining the displacement path of the hinge support consists in that a stop serving as limiting means is provided for the hinge support at the side wall of the housing associated with the guide device in the region facing the open side of the housing.

A particularly preferred construction of the invention is characterized in that the guide device comprises at least one horizontal guide rail arranged at the side wall of the housing, the hinge support being supported at such guide rail so as to be displaceable.

A construction which is simple in design yet which enables a stable and accurate guidance is provided in a further development of the invention in that the hinge support is guided at every guide rail by means of four guide rollers which are arranged opposite one another in pairs so as to contact the upper and lower guide surface of the guide rail without play and in that the two pairs of guide rollers are arranged at a distance from one another in the longitudinal direction of the guide rail and are secured in such a way that the guide rollers cannot be pulled away from the guide rail in the axial direction.

A preferred construction for securing the guide rollers at the respective guide rail is characterized in that every guide rail cooperates with the guide rollers in a positive engagement considered in the axial direction of the guide rollers. In a construction of this kind, the guide rail can have a rectangular cross section, the narrow sides of the cross section serving as guide surfaces, and the guide rollers are provided with wheel rims which tightly contact the broad sides of the guide rail. According to, another construction of the invention, every guide rail can have, at its upper and lower guide surface, a guide profile diverging from the planar boundary, the profile of the guide roller being adapted to this guide profile. For this purpose, the guide surfaces can have, e.g., wedge-shaped depressions to which the guide rollers are adapted by means of a wedge-shaped profile which tapers outward radially. However, it is also possible for the guide rail to have a raised profile, e.g., a wedge-shaped or half-round profile, to which the guide rollers are adapted by means of a corresponding wedge-shaped or half-round depression provided at the outer circumference.

According to another construction of the invention it is also possible for the guide rail to have a dovetail-shaped profile and for the hinge support to be displaceable on the guide rail via a recess which is adapted to the guide rail.

Further, the hinge support can be held so as to be displaceable by means of an accordion grate or slidable grate.

For a better understanding of the present invention, reference is made to the following description and accompanying drawings while the scope of the invention will be pointed out in the appended claims.

DESCRIPTION OF THE PREFERRED EMBODIMENTS

Figure 1:
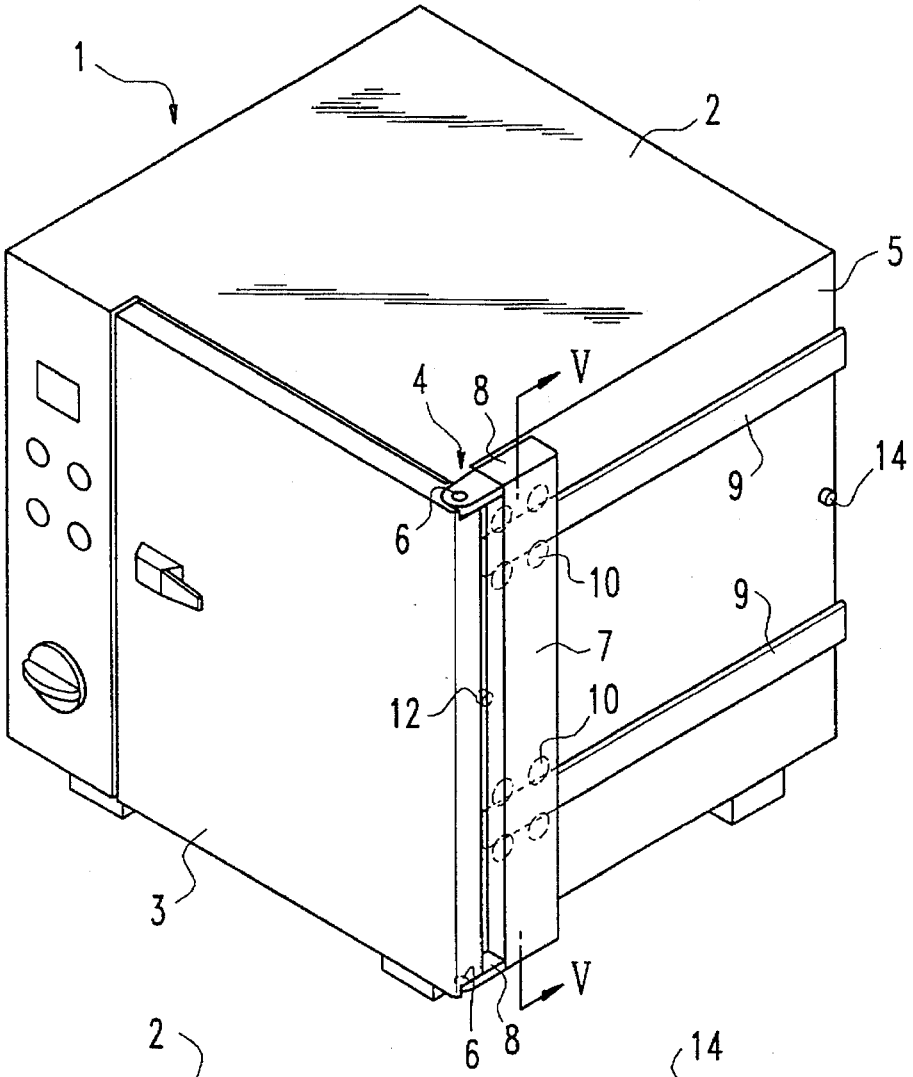
FIG. 1 shows a perspective view of a cooking device according to the invention.
Figure 2:
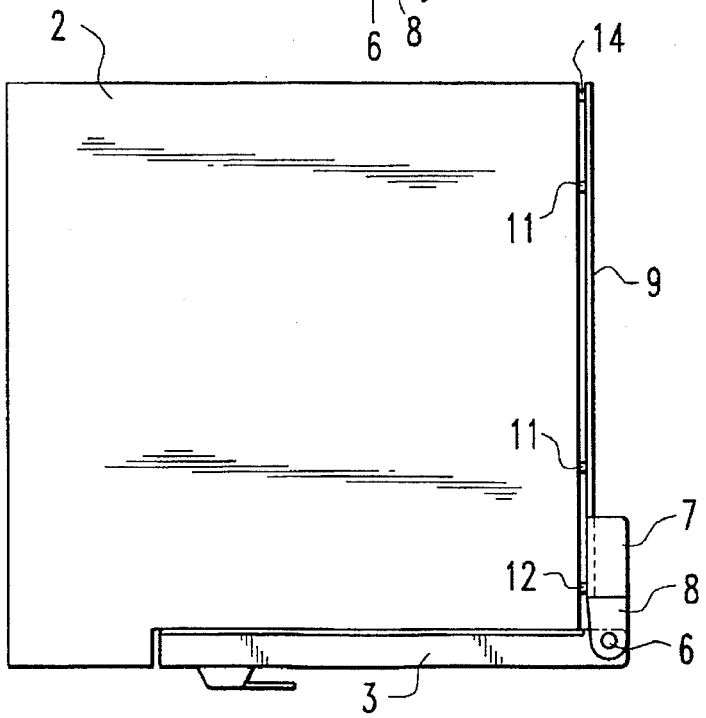
FIG. 2 shows a top view of the cooking device according to FIG. 1.

In a cooking device, designated in general by 1, a door 3 is supported by a hinge arrangement 4 at the front side of the housing 2 so as to be swivelable about a vertical axis. As can be seen from FIGS. 3 and 4, this door is displaceable in the open state alongside the side wall associated with the hinge arrangement 4 so that it does not project into the work space in front of the device. The hinge arrangement 4 comprises a hinge part which is connected with the door 3 and constructed as a bearing journal 6 and a hinge part 8 which is fastened to a hinge support 7.

Figure 3:
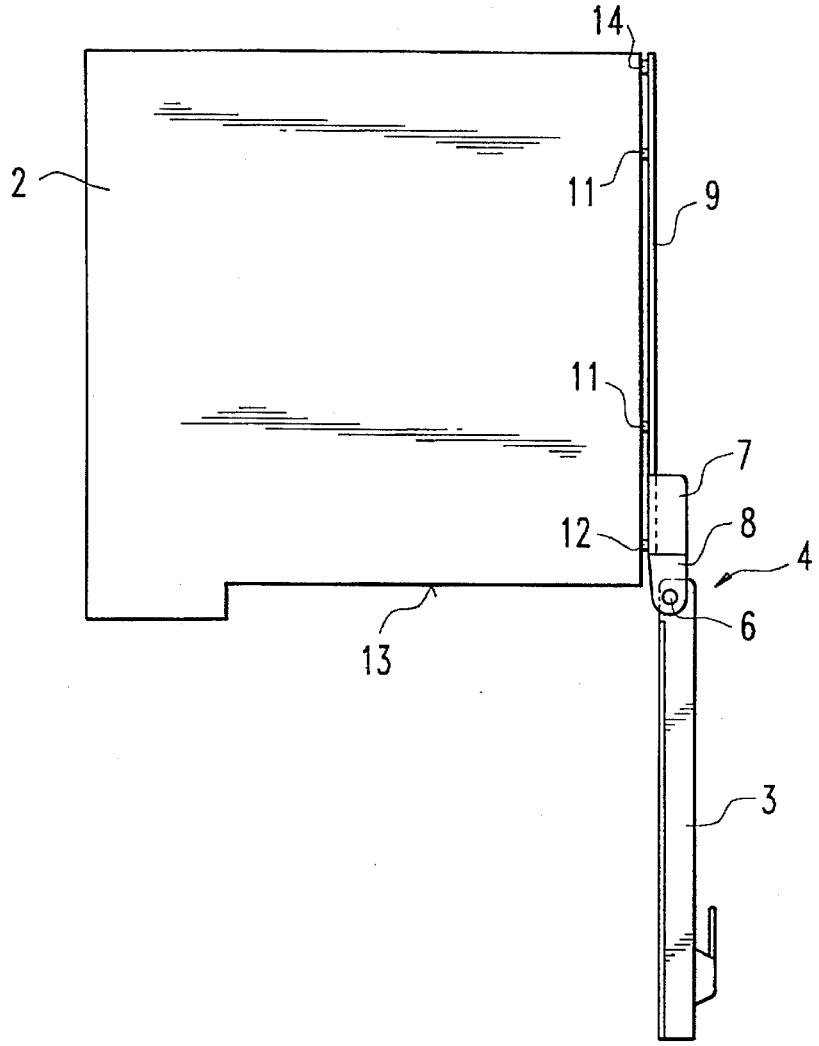
FIG. 3 shows a top view according to FIG. 2 with open door.
Figure 4:
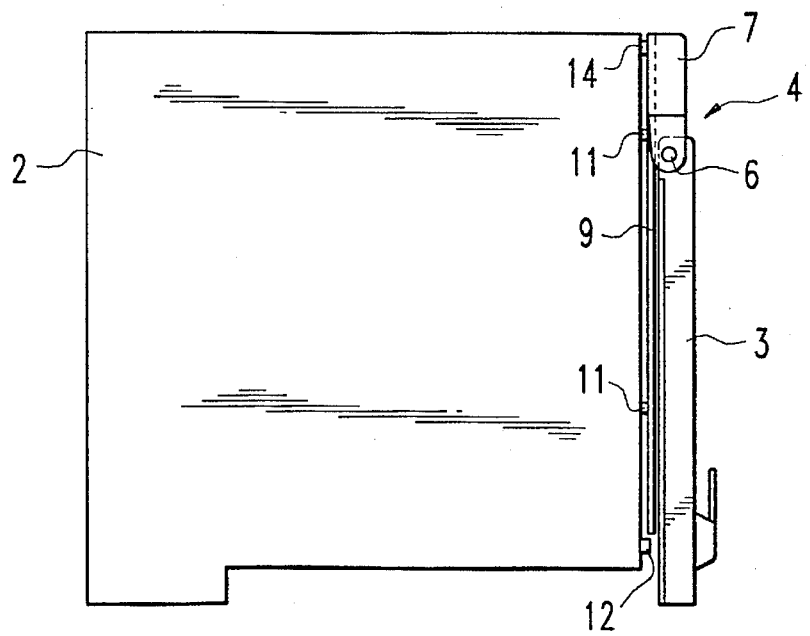
FIG. 4 shows a top view corresponding to FIG. 3 with the door slid in laterally adjacent to the device.
Figure 5:
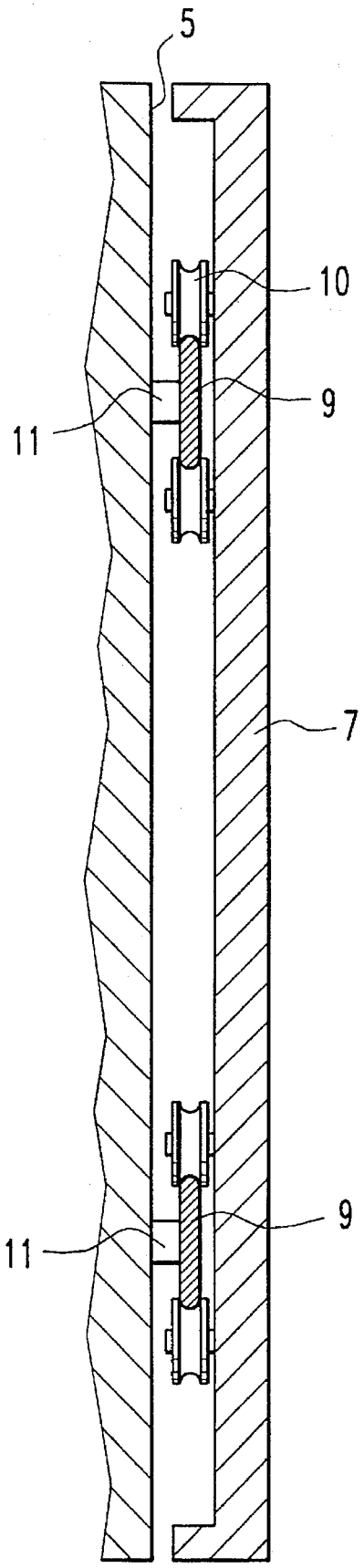
FIG. 5 shows a section according to line V—V in FIG. 1.

The hinge support 7 is guided at a guide device so as to be displaceable along the side wall 5 so that the door can be moved from the open position shown in FIG. 3 into the position shown in FIG. 4. In this embodiment example, the guide device has two guide rails 9, the hinge support 7 which is constructed as a vertically disposed slide or carriage being guided at the guide rails 9 by means of guide rollers 10. Four guide rollers 10 are associated with each guide rail 9. The guide rollers are arranged opposite one another in pairs and are thus arranged at the hinge support 7 in such a way that they cooperate with the guide rail 9 so as to be free of play. Each pair of guide rollers located opposite one another is arranged at a certain distance from the other pair of guide rollers so as to prevent a tilting of the hinge support 7 about an imaginary horizontal axis. The guide rail 9 is fitted to the side wall 5 of the housing 2 by means of holders 11.

In order to allow the door 3 to be slid into the position alongside the cooking device as shown in FIG. 4, it is necessary that the swivel axis of the hinge arrangement 4 extending through the beating journal 6 lie in an imaginary plane extending parallel to the side wall 5 of the housing 2 at a distance therefrom.

In order to prevent the guide rollers 10 from being pulled away from the guide rails 9 in the axial direction of the guide rollers, the upper and lower guide surfaces of each guide rail 9 are constructed in a convex manner and the guide rollers 10 have a concave guide groove at their circumference so that the guide rollers 10, considered in their axial direction, cooperate in a positive engagement with the guide rails 9 in order to prevent a lateral lifting of the hinge support 7 from the guide rails and accordingly from the side wall of the cooking device.

A stop 12 is provided in the front region of the side wall 5 facing the door opening. The hinge support 7 contacts this stop 12 in the position in which it is displaced toward the front and which allows the door to be closed. The stop 12 is positioned in such a way that when the hinge support 7 contacts this stop 12 the hinge arrangement 4 is located in a position such that the door 3 supported by the hinge arrangement 4 tightly contacts the from side 13 of the housing 2 on all sides. A limit stop 14 is provided at the side wall 5 at the rear end of the displacement path.

While the foregoing description and drawings represent the preferred embodiments of the present invention, it will be obvious to those skilled in the art that various changes and modifications may be made therein without departing from the true spirit and scope of the present invention.

What is claimed is:

1. A cooking device comprising:

a housing having a from opening, a side and rear wall, a lateral surface and a front edge;

a door which closes said front opening in said housing;

a hinge arrangement having a vertical swivel axis, said door being swivelable about said vertical swivel axis by said hinge arrangement;

a hinge support;

said hinge arrangement having one part which is arranged at the door and another part which is arranged at said hinge support;

a guide device;

said hinge support being displaceable along said housing side wall adjacent to said hinge arrangement toward said housing rear wall by said guide device;

said swivel axis of said hinge being arranged in a plane parallel to and at a distance from said lateral surface of said housing; and limiting means for limiting a displacement path of the hinge support in the direction of the housing opening to a required distance between the swivel axis of the hinge arrangement and the front edge of the housing.

2. The cooking device according to claim 1, wherein a stop serving as limiting means is provided for the hinge support at the side wall of the housing associated with the guide device in a region facing the open side of the housing.

3. The cooking device according to claim 1, wherein the guide device comprises at least one horizontal guide rail arranged at the side wall of the housing, the hinge support being supported at such guide rail so as to be displaceable.

4. The cooking device according to claim 3, wherein the hinge support is guided at every guide rail by four guide rollers which are arranged opposite one another in pairs so as to contact the upper and lower guide surface of the guide rail without play, and wherein the two pairs of guide rollers are arranged at a distance from one another in the longitudinal direction of the guide rail and are secured in such a way that the guide rollers cannot be pulled away from the guide rail in the axial direction of the guide rollers.

5. The cooking device according to claim 4, wherein every guide rail cooperates with the guide rollers in a positive engagement considered in the axial direction of the guide rollers.

6. The cooking device according to claim 5, wherein every guide rail has, at an upper and lower guide surface, a guide profile diverging from the planar boundary, the profile of the guide rollers being adapted to this guide profile.

7. The cooking device according to claim 5, wherein every guide rail has a rectangular cross section, the narrow sides of the cross section serving as guide surfaces, and wherein the guide rollers are provided with wheel rims which tightly contact the broad sides of the guide rail.

8. The cooking device according to claim 3, wherein the rail has a dovetail-shaped profile and the hinge support is displaceable on the guide rail via a recess which is adapted to the guide rail.

* * * * *

UNITED STATES PATENT AND TRADEMARK OFFICE

CERTIFICATE OF CORRECTION

PATENT NO. : 5,657,743

DATED : August 19, 1997

INVENTOR(S) : Werner Schwarzbaecker et al

It is certified that error appears in the above-identified patent and that said Letters Patent is hereby corrected as shown below:

Column 1, line 19, change "from" to --front--;

Column 1, line 20, change "fired" to --fitted--;

Column 2, line 23, change "to," to --to--;

Column 3, line 26, change "beating" to --bearing--;

Column 3, line 47, change "from" to --front--;

Column 3, line 57 (claim 1), change "from" to --front--.

Signed and Sealed this

Sixteenth Day of December, 1997

*Attest:*

*Attesting Officer*

BRUCE LEHMAN

*Commissioner of Patents and Trademarks*